US006408731B1

(12) United States Patent
Elsener

(10) Patent No.: US 6,408,731 B1
(45) Date of Patent: Jun. 25, 2002

(54) LIQUID DISRUPTER WITH REDUCED RECOIL

(75) Inventor: Josef Elsener, Carignan (CA)

(73) Assignee: Proparms Ltd., Carignan (CA)

( * ) Notice: Subject to any disclaimer, the term of this patent is extended or adjusted under 35 U.S.C. 154(b) by 0 days.

(21) Appl. No.: 09/700,412

(22) PCT Filed: Jun. 9, 1999

(86) PCT No.: PCT/CA99/00539

§ 371 (c)(1),
(2), (4) Date: Nov. 15, 2000

(87) PCT Pub. No.: WO99/64808

PCT Pub. Date: Dec. 16, 1999

Related U.S. Application Data

(60) Provisional application No. 60/088,835, filed on Jun. 10, 1998.

(51) Int. Cl.[7] ..... F42B 33/00; F41A 25/00

(52) U.S. Cl. ..... 86/50; 102/440; 42/1.11; 89/1.11; 89/43.01

(58) Field of Search ..... 86/49, 50; 102/437, 102/440; 42/1.11, 1.14; 89/42.01, 43.01, 1.11

(56) References Cited

U.S. PATENT DOCUMENTS

| | | | | |
|---|---|---|---|---|
| 3,779,130 A | * | 12/1973 | Schnabele | 89/1.701 |
| 4,478,128 A | * | 10/1984 | Black et al. | 102/440 X |
| 5,105,715 A | * | 4/1992 | Nordmann et al. | 89/42.01 X |
| 5,515,767 A | * | 5/1996 | Gilbert | 86/50 X |
| 5,743,246 A | | 4/1998 | Mattern | 124/56 |
| 5,841,056 A | * | 11/1998 | Long et al. | 86/50 |
| 5,966,858 A | * | 10/1999 | Curtis et al. | 42/1.14 |
| 6,116,136 A | * | 9/2000 | Kirschner et al. | 89/43.01 |
| 6,269,725 B1 | * | 8/2001 | Cherry | 86/50 |

FOREIGN PATENT DOCUMENTS

| | | |
|---|---|---|
| CH | 309 598 A | 9/1955 |
| EP | 0 178 039 A | 4/1986 |
| GB | 2 083 894 A | 3/1982 |
| GB | 2 291 958 A | 2/1996 |
| GB | 2 299 156 A | 9/1996 |
| WO | WO 92 05396 A | 4/1992 |
| WO | WO 95 14207 A | 5/1995 |

* cited by examiner

*Primary Examiner*—Peter A. Nelson
(74) *Attorney, Agent, or Firm*—Francois Martineau

(57) ABSTRACT

The disrupter (16) includes an elongated hollow barrel (18) having a cylindrical inner chamber (20), a closed rear (26) end and an opened front end (22), the latter closed with a front frangible seal (38). A channel member (46) partly surrounds an intermediate portion of the barrel, and is securely attached thereto. A pair of recoil channels (76, 78) extend from the barrel inner chamber, radially outwardly and rearwardly through the barrel and the channel member, and are linked to rearwardly oriented recoil tubes (52, 54) which have opened rear end portions (60, 62) closed with rear frangible seals (64, 66). In use, a cartridge (90) including an explosive charge (88) is to be inserted in the barrel inner chamber at its rear end, and the barrel, recoil channels and recoil tubes (52, 54) are to be filled with water. The frangible seals (38, 64, 66) prevent the water from leaking out of the disrupter while it is positioned near a bomb to be deactivated. A trigger (36) is linked to the disrupter, and more particularly to the cartridge, to remotely detonate the explosive charge. Upon the explosive charge being detonated, a portion of the water is propelled and ejected at high velocity out through the barrel front end, rupturing the front frangible seal, to puncture the bomb outer shell and deactivate the bomb inner detonating components. Another portion of the water is redirected through the side recoil channels and recoil tubes, rupturing the rear frangible seals, to be ejected rearwardly out of the disrupter. The recoil created by the detonation of the explosive charge which ejects the water through the barrel front end, is at least partially counteracted by the water being laterally and rearwardly redirected to be ejected rearwardly out through the recoil tubes. The recoil tubes have at their rear ends (60, 62) transverse blades (73, 74) for wide angle dispersal of the fluid jet being ejected rearwardly.

16 Claims, 4 Drawing Sheets

LIQUID DISRUPTER WITH REDUCED RECOIL

CROSS-REFERENCE DATA

The present application claims the conventional priority of U.S. provisional application No. 60/088,835 filed on Jun. 10, 1998.

FIELD OF THE INVENTION

The present invention relates to disrupter systems, and more particularly to a recoil controlled bomb disrupter.

BACKGROUND OF THE INVENTION

It is known to provide bomb disrupters which disrupt or deactivate the bombs by blasting a high-velocity water jet against the bomb. A disrupter of known configuration includes a main hollow cylindrical barrel having a closed rear end portion and a sealable opened front end mouth portion. A water-tight explosive charge or cartridge is loaded inside the barrel at the rear end thereof and the barrel is then filled with water before the front end of the barrel is closed with a frangible water-tight seal. The disrupter is carried towards the bomb to be deactivated, for example by means of an automated remote control rover which is equipped with a video camera which allows remote visual inspection of the bomb as the rover approaches same. The disrupter barrel front end mouth is oriented towards the bomb along a selected direction, and the explosive charge therein is then detonated. Upon the charge exploding in the barrel, the water therein is propelled out of the barrel at high velocity (approximately at the speed of sound), rupturing the frangible seal closing the opened front end of the barrel. The thus ejected water then punctures the bomb outer casing at short range, and penetrates inside the bomb to damage the inner circuits and other detonating components thereof, to effectively deactivate the bomb. The high water speed is such that any tamper-proof detection means in the bomb does not have time to detect and prematurely detonate the bomb before the bomb is deactivated. Typically, a few milliseconds is what it takes to deactivate the bomb.

The problem associated with the above-described disrupter system is that the barrel will often be accidentally released brutally from its support on the robot to be backwardly projected, reactively under the counter-force or recoil of the explosive charge detonating inside the barrel and outwardly blasting the water. Often, such a disrupter severely damages or completely destroys the rover carrying it, and may also damage the video camera located on the robot, or other expensive equipment located thereon In addition to replacement or repair costs of the thus damaged equipment, damaging the video camera also has the drawback of taking away the available means to readily visually inspect the results of the water blast immediately after it has occurred, to verify whether the bomb has effectively been deactivated.

British patent NO. GB 2 299 156 A (published in September 1996)—hereinafter, the 156' patent, shows in the embodiment of FIG. 6, a barrel 2, to the rear end of which is coaxially mounted a reaction absorbing element. Threaded connection occurs between the barrel and the reaction absorbing element. A bridge fits inside the reaction absorbing element, with a breech at the rear end thereof and a front air bore extending to the rear end of the barrel. A recoil cylinder array is mounted around the reaction absorbing element. Air channels provide air circulation between the front air portion of the recoil cylinders inside boring and the air boring extending between the bridge 16 and the rear end of the barrel.

It is clear from inspection of FIG. 6 of the 156' patent that:

a) the radial channels are air passageways between the barrel inner chamber and the recoil cylinders inner chambers, i.e. they are not designed for water or other liquid flow, at any moment during operation of this liquid disrupter. Indeed, when explosion occurs at the level of the rear breech, the water present in the barrel will flow forwardly away from the radial channels, and the water present in the rearward portions of the cylinders will flow rearwardly again away from the radial channels.

b) the radial passageways open rearwardly spacedly from the rear end of the barrel, and never engage into the barrel inner chamber proper.

c) therefore, the recoil cylinders and the barrel are NOT in liquid communication with one another.

In such a disrupter arrangement as in the 156' patent, the threaded connection constitutes a weak spot, since the threads will rapidly become stretched and deformed, under explosion borne air pressure loads, bringing structural fatigue and possible disrupter failure. Accordingly, such a disrupter device has low durability and low operating safety levels. Moreover this patent is made up of three main parts: the reaction absorbing element, the barrel and the cylinder array. Also, the (pneumatic) air pressure buffer zone between the liquid filled recoil cylinders and the liquid filled barrel, means that since air is a lighter fluid in mass per volume than water, under explosive load pressure force, the air will move toward the lesser resistance area i.e. toward the barrel and a very small fraction of the air will be expelled to engage into the recoil cylinders; hence, although reduced, there will still be some substantial recoil remaining.

Finally, in the FIG. 1 of the 156' patent, is it noteworthy to mention that because of the illustrated small diameter size of the boring in the so-called plug, the radial flange and thus the disrupter itself is likely to be inoperative because the diameter of the central boring in the plug is much too restricted to enable enough air from the explosion to bring sufficient pressure to accelerate the water inside the barrel to reach the approximately 360 meters per second standard requirement for attaining minimal effective water jet speed to disrupt a bomb without triggering the anti-tampering built-in system of the bomb. As illustrated in FIG. 1, the boring diameter size would require such level of air pressure that the overall disrupter assembly would most likely disintegrate the first time it is used, due to its integrity being compromised, in particular due to stress applied about the threads linking the barrel, the plug flange and the device rear body portion.

OBJECTS OF THE INVENTION

It is an object of the present invention to provide a bomb disrupter with a controlled recoil effect.

A corollary object of this invention is to prevent occurrence of collateral damage to the supporting rover of said bomb disrupter upon actuation thereof.

A general object of the invention is to enhance the efficiency of use of bomb disrupters by providing a bomb disrupter and supporting rover assembly which are reusable several times and is therefore long lasting.

SUMMARY OF THE INVENTION

The present invention relates to a recoil controlled bomb disrupter.

The present invention more particularly relates to a disrupter for deactivating a bomb comprising:

a main elongated hollow barrel having a closed rear end and an opened front end;

at least two recoil pipes equally peripherally spaced about said barrel, said recoil pipes being in sealed fluid connection with and outwardly and rearwardly extending on opposite sides of said barrel intermediate said front and rear ends, said pipes each having a first end opening into said barrel and an opposite opened second end at least partially rearwardly oriented;

a remotely selectively controlled trigger member operatively mounted to said barrel; wherein an explosive charge is to be placed inside said barrel near said rear end and connected to said trigger member, and said barrel and said lateral pipes are to be filled with fluid, and wherein upon the explosive charge exploding when it is detonated by said trigger member, a portion of the fluid is ejected at high velocity frontwardly out of said barrel to puncture the bomb outer shell and deactivate the bomb inner detonating components, and another portion of the fluid concurrently engages said recoil pipes to be rearwardly ejected out of said recoil pipes, which at least partly counteracts the rearward recoil resulting from the explosive charge projecting the water frontwardly out of said barrel.

Preferably, said recoil pipes each have a first channel section transversely rearwardly extending from said barrel inner chamber and a second channel section in continuous fluid connection with said first channel section and rearwardly extending parallel to said barrel inner chamber.

The invention further relates to a disrupter for deactivating a bomb comprising:

a main elongated hollow barrel having a cylindrical inner chamber, a closed rear end and an opened front end closed with a front frangible seal;

a channel member having a bore engaged by said barrel, said channel member being securely attached to said barrel;

at least two recoil channels equally peripherally spaced about said barrel, said channels having a first end opening inside said barrel inner chamber intermediate said front and rear ends, and a second end rearwardly opening out of said channel member and closed with rear frangible seals, said channels radially outwardly and rearwardly extending through said barrel and said channel member from said first to said second ends;

a remotely selectively controlled trigger member operatively mounted to said barrel; wherein an explosive charge is to be placed inside said barrel inner chamber near said rear end and connected to said trigger member, and said barrel and said lateral pipes are to be filled with fluid, and wherein upon the explosive charge exploding when it is detonated by said trigger member, a portion of the fluid is ejected at high velocity frontwardly out of said barrel front end, rupturing said front frangible seal, to puncture the bomb outer shell and deactivate the bomb inner detonating components, and another portion of the fluid concurrently engages said recoil channels, rupturing said rear frangible seals, to be rearwardly ejected out of said recoil channels, which at least partly counteracts the rearward recoil resulting from the explosive charge projecting the water frontwardly out of said barrel.

Preferably, each said recoil channel includes a first and a second channel sections, said first channel section extending through said barrel and said channel member in a radially outwardly and rearwardly inclined fashion relative to said barrel, and said second channel section being a recoil tube securely attached to said channel member and rearwardly projecting from said first channel section, said recoil channel second end being located at the rear end of said recoil tube.

Preferably, each said recoil tube is provided with transverse blades at their rear ends, for dispersing the fluid jet being ejected out of said recoil tubes.

Preferably, each said recoil tube is provided with a bored cap threadingly engaging its rear end, said cap holding said rear frangible seal and being provided with a transverse blade for dispersing the fluid jet being ejected out of said recoil tube.

Preferably, said barrel includes a radially protruding peripheral shoulder intermediate said front and rear ends, with said channel member including an inner peripheral channel member seat about said bore for seating abutment against said barrel shoulder, said disrupter further including an attachment ring axially engaging said barrel and including an inner peripheral ring seat for seating abutment against said barrel shoulder opposite said channel member, said ring threadingly engaging said channel member to securely attach said channel member against said barrel.

Preferably, said first channel section extends through said barrel and through said barrel shoulder.

Preferably, said barrel front end portion is provided with a securely attached nozzle holding said frangible seal against said barrel front end, said nozzle further having a convergent inner surface to accelerate the outgoing fluid jet.

Preferably, the nozzle inner convergent surface defines a 15° angle relative to the axis of the barrel cylindrical inner chamber.

Preferably, said barrel rear end is releasably closed with a removable cover securely attached to said barrel, said cover carrying said trigger member.

The invention also relates generally speaking to a water gun comprising:

a main elongated barrel having a first inner channel for receiving and holding a volume of water and provided with a front water outlet end mouth and a rear closed end portion, said first channel rear end portion including a well for receiving an explosive charge;

a tubular array integrally mounted in radially outward fashion to a section of said main barrel intermediate said front and rear end portions thereof, said tubular array consisting of at least two elbowed tube members, said tube members being peripherally equidistant to each other;

each elbowed tube member having a forward portion, mounted to and radially outwardly and rearwardly extending from said barrel intermediate section and defining a second inner channel in fluid communication with said barrel first channel, and a rearward portion, projecting rearwardly from the latter tube forward portion and extending in radially spaced parallel fashion relative to said barrel rear end portion and defining a third inner channel in fluid communication with said second inner channel of the latter tube, each one of said third inner channels having a rear water outlet mouth:

wherein each of said second channels extend radially inwardly into said first channel, to define peripherally spaced water flow deflecting ribs located peripherally of said first channel; wherein upon loading a volume of water to fill at least said first channel and upon ignition of the explosive charge inside said well, a major portion of this volume of water is ejected forwardly along said barrel first channel and outwardly through said barrel front outlet end mouth, while a remaining smaller portion of this volume of water is deflected by said deflecting ribs and backflowed rearwardly radially outwardly into said elbowed tube members to be ejected rearwardly, wherein the water gun recoil is controlled.

Preferably, the diameter of each of said second channels is identical to one another but diametrally smaller than any one of said first and third channels.

There could be added water dispersal members, each mounted to a corresponding one of each of said tube member rearward portion rear outlet mouths, said dispersal members for wide angle dispersal of water flow ejected rearwardly through said rear outlet mouths.

Preferably, there is further included a dynamic pressure sensitive frangible seal mounted to said front outlet end mouth of said barrel, and/or to said rear outlet end mouths of said tube members, in the latter case for use when the initial volume of water fills also said second and third channels.

The barrel front end mouth could be conical, preferably with a conicity angle of about 15 degrees, for reducing the barrel diameter at its frontmost end to produce a more powerful jet of frontward water flow.

DETAILED DESCRIPTION OF THE EMBODIMENTS

Figure 1:
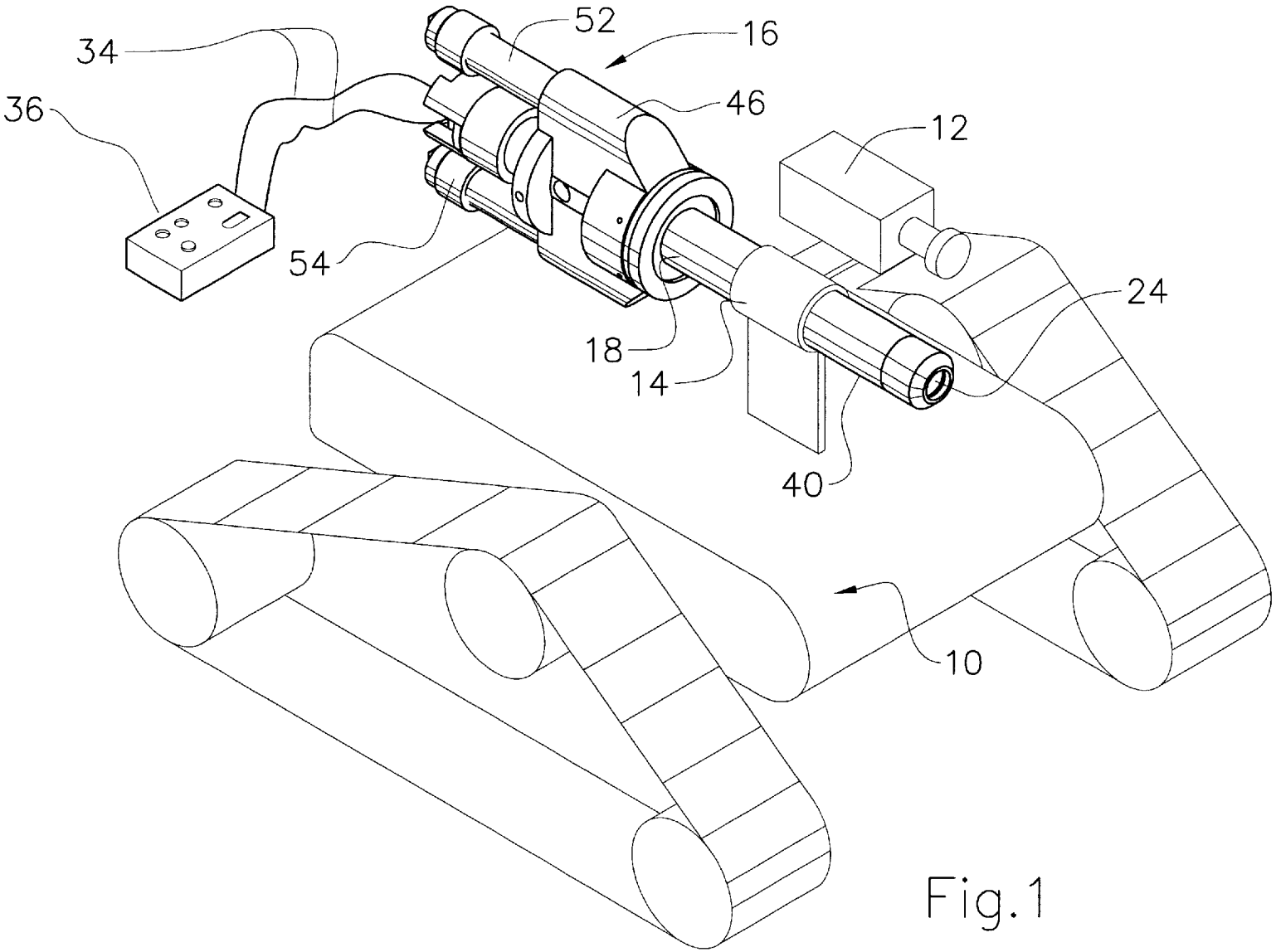
FIG. 1 is a front perspective view of a disrupter according to the invention, the disrupter being operatively mounted to a schematically illustrated automated remote control robot or "rover"

FIG. 1 schematically shows a small automated tracked robot 10 used by law enforcement agencies to carry bomb disrupters in an urban environment. Robot 10 is equipped with a video camera 12 allowing visual inspection of a bomb from a remote location, and with a disrupter support bracket 14 which securely holds a bomb disrupter 16 spacedly over the rover 10 according to the invention.

Figure 2:
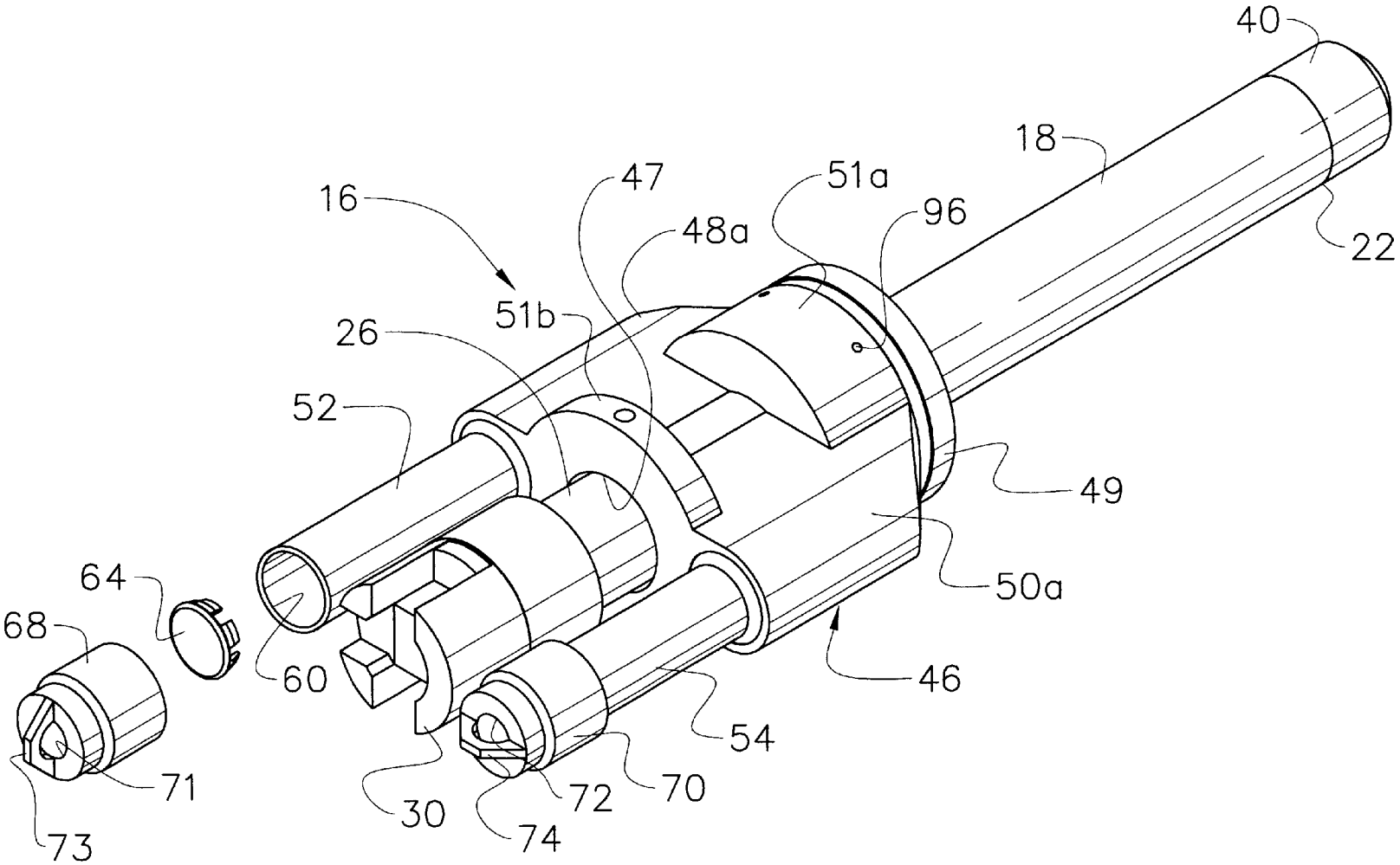
FIG. 2 is a rear perspective view of the disrupter of the invention, with a rear recoil cap with its corresponding frangible seal being removed from their recoil tube.
Figure 3:
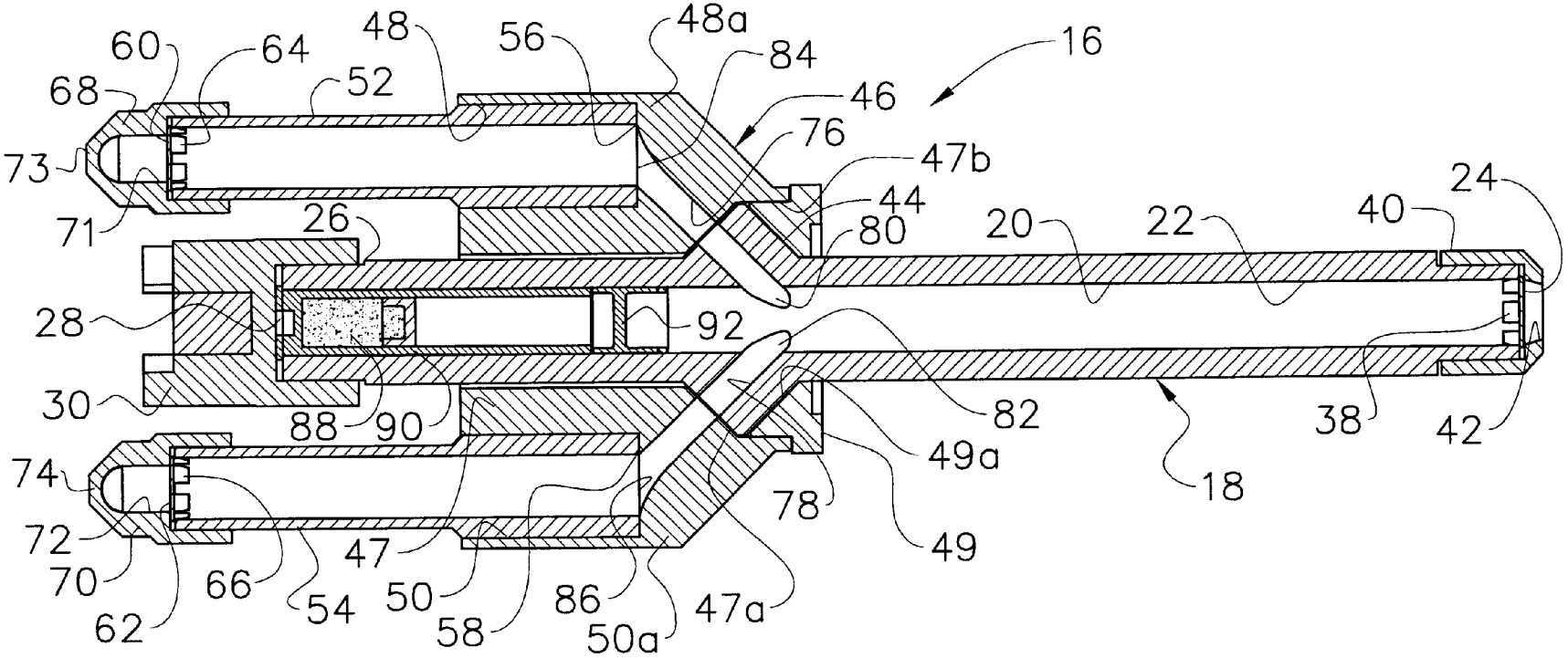
FIG. 3 is a longitudinal cross-sectional view of the disrupter of the invention.
Figure 4:
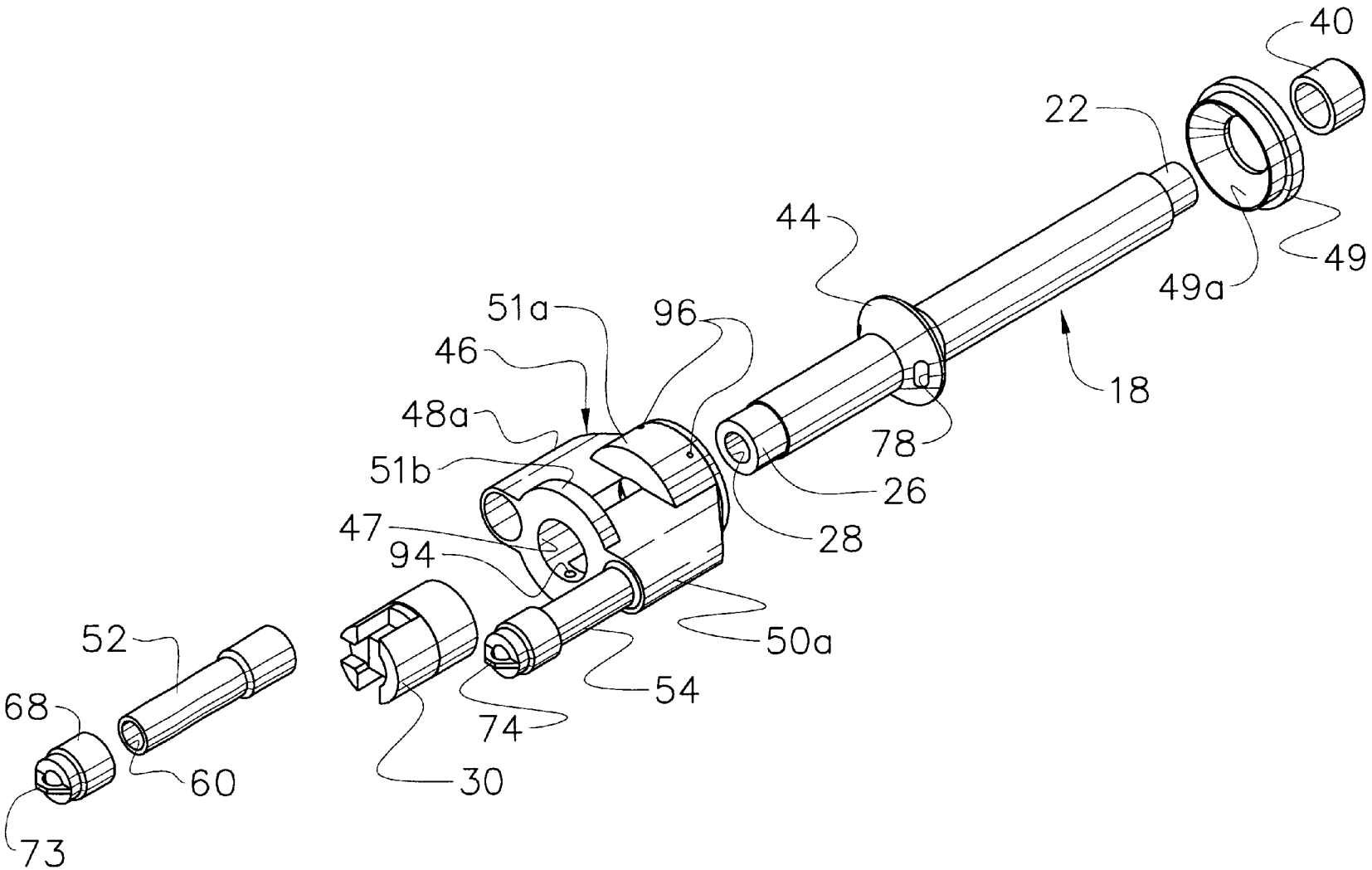
FIG. 4 is a rear exploded perspective view of the disrupter of the invention.

As shown in FIGS. 2, 3 and 4, disrupter 16 comprises a main elongated hollow barrel 18 which has a cylindrical inner chamber 20 and which defines a front end portion 22 having a front mouth opening 24, and a rear end portion 26 having a rear opening 28. The barrel rear opening 28 is releasably but securely closed with a screwable rear barrel cover 30 which is equipped with a trigger member in the form of wires 34 operatively connected to cover 30 and to a manually operable control panel 36 which can be remotely handled, as will be described hereinafter and as known in the art. Of course, wires 34 may be much longer than shown in FIG. 1, for safety of the operator.

The barrel front opening 24 is closed with a frangible water-tight seal 38 which is held against the barrel front end portion 22 by means of a nozzle 40 threadingly engaging the barrel front end portion 22. The nozzle 40 has a front bore 42 axially aligned with the barrel front opening 24. Preferably, as shown in FIG. 3, the nozzle front bore 42 has an axially frontwardly convergent inner surface. Preferably, the lumen of nozzle opening 42 is conical with its radially inward diameter decreasing axially outwardly toward frontmost end of mouth 24. Most preferably. the conicity angle will be about 15 degrees. Will have a 15° angle relative to the barrel longitudinal axis.

According to the invention, barrel 18 is further provided, intermediate its front and rear end portions 22, 26, with an integral radially protruding peripheral shoulder or rib 44 (FIGS. 3 and 4) which radially outwardly tapers to form a generally triangular cross-sectional shape. Disrupter 16 also comprises a channel member 46 defining a pair of opposite side wings 48*a*, 50*a* spaced from each other and integrally tangentially formed on opposite sides of a front and a rear collar 51*a* and 51*b* (FIG. 2) which are axially aligned so as to form a central bore 47. Front collar 51*a* is axially longer than rear collar 51*b*, and has a frontwardly divergent inner bore surface forming a peripheral seat 47*a* (FIG. 3) and a frontmost cylindrical threaded surface 47*b*. Barrel 18 is sized to axially engaged bore 47 until shoulder 44 rearwardly abuts against seat 47*a*.

A ring 49 having a rearwardly divergent surface forming a peripheral seat 49*a* is engaged by barrel 18, with ring 49 being outwardly threaded to be screwed into the inner bore 47*b* of channel member 46, until ring seat 49*a* axially rearwardly abuts against the barrel shoulder 44. Thus, channel member 46 is securely releasably attached to barrel 18.

Channel member 46 has a pair of rearwardly opened and peripherally equidistant tube channels 48, 50 located in respective side wings 48*a*, 50*a*. Tube channels 48, 50 are threaded to be respectively engaged by a first and a second hollow recoil tubes 52, 54. Recoil tubes 52, 54 extend spacedly radially outwardly parallel to barrel 18 and each have opened front and rear ends 56, 58 and 60, 62 respectively, with rear ends 60, 62 being closed with frangible seals 64, 66 held against the rear ends 60, 62 with rigid rear recoil caps 68, 70 threadingly engaging the peripheral portions of the tube rear ends 60, 62. As shown in FIGS. 2 and 3, recoil caps 68, 70 are provided with through-bores 71, 72 and with arcuate and rearwardly extending blades 73, 74 transversely extending across and behind bores 71, 72. Preferably, blades 73, 74 have sharp frontmost inner edges.

Disrupter 16 is further provided with a pair of transversely extending and peripherally equidistant divergent side channels 76, 78 which have a first opening 80, 82 inside the barrel inner chamber 20 at an intermediate portion of barrel 18, which extend through the barrel 18 peripheral wall, through peripheral shoulder 44 and through front collar 51*a* of channel member 46, and which have a second opening 84, 86 at the front end of the tube channels 48, 50 respectively. Thus, channels 76, 78 fluidingly link inner chamber 20 to respective recoil tubes 52, 54 by extending radially outwardly and rearwardly from the former to the latter. Channels 76, 78 preferably have an ovoidal crosssection, although a circular or other suitable cross-section is also acceptable.

In use, an explosive charge 88 held in a water-tight cartridge 90 is installed inside barrel 18, at the rear end portion 26 thereof. A piston plug 92 is further inserted forwardly of cartridge 90. Cartridge 90 should allow an operative connection between explosive charge 88 and the trigger member, e.g. by means of an electric contact with wires 34, to allow charge 88 to be detonated through the instrumentality of control panel 36. The cartridge 90 and piston plug 92 can be both inserted by removing rear barrel cover 30, the latter then being securely screwed onto the barrel rear end portion 26 to close rear opening 28. Two of the three frangible seals 38, 64, 66 are operatively positioned as shown in FIG. 3, with one seal, for example front seal 38, being left uninstalled to leave one opened end to allow the barrel inner chamber 20, the channels 76, 78 and the recoil tubes 52, 54 to be filled with water. Once this is completed, front seal 38 is installed together with nozzle 40.

The disrupter 16 is then installed with its front mouth opening 24 oriented towards the bomb to be disarmed. For example, disrupter 16 can be carried with remote control rover 10 as shown in FIG. 1, while video camera 12 allows remote visual inspection of the bomb without the person controlling the rover risking any physical injury if the bomb accidentally detonates. Since all the disrupter openings are sealed with water-tight frangible seals 38, 64, 66, disrupter 16 may be oriented in any direction, without any risk of the water accidentally leaking out of disrupter 16. Indeed, the bracket 14 holding disrupter 16 on robot 10 may be provided on an articulated arm (not shown), for example for positioning disrupter 16 vertically over the bomb, with barrel 18 pointing downwardly towards the bomb. Alternately, manual positioning of disrupter 16 can be accomplished, for example on a suitable tripod.

Once the disrupter is in a selected position, control panel 36 can be manually operated to remotely trigger and detonate the explosive charge 88. The explosion of charge 88 will cause an important and sudden pressure rise in the barrel rear end portion 26, which will frontwardly propel piston plug 92. In turn, the water located inside barrel 18 will be frontwardly propelled by piston plug 92. Part of this water will be propelled towards the front end portion 22 of barrel 18, while another part of this water will be propelled transversely into the side channels 76, 78 and into the rearwardly oriented recoil tubes 52, 54. The thus propelled water will rupture the frangible seals 38, 64, 66, to be ejected at high velocity out of disrupter 16. The water ejected through the front opening 24 will be accelerated by the convergent nozzle opening 42 and will be projected against the bomb, to puncture the bomb outer shell and penetrate inside the bomb to damage the inner circuits and other detonating components thereof, to effectively deactivate the bomb. The high water speed, resulting from the sudden explosion of charge 88, is such that the time lag between water contact on the bomb outer shell and bomb deactivation is shorter than the actuation time for any tamper-proof detection means located in the bomb.

According to the invention, a fraction of the body of water ejected by the blast will not move forwardly through barrel 20, but rather rearwardly radially outwardly by engaging elbowed rearwardly outwardly diverging channels 76, 78, and rearwardly out through parallel rearward recoil tubes 52, 54. Such water motion will counteract the recoil resulting from the explosion inside barrel 18. Indeed, the explosion projecting the water forwardly out of the barrel front mouth opening 24 will effectively create a recoil effect that will tend to brutally bias disrupter 16 rearwardly. However, by allowing a certain quantity of water to be reoriented into the radially outwardly and rearwardly inclined diverging channels 76, 78 and then out through parallel rearward recoil tubes 52, 54, a frontward force is imparted on disrupter 16 which at least partially or preferably completely counteracts the rearward force or recoil on disrupter 16. The sideward forces imparted upon disrupter 16 by the sidewardly extending channels 76, 78 counteract each other, since both channels are symmetrically sidewardly oriented in opposite directions to prevent accidental radially lateral displacement of disrupter 16. Once piston plug 92 is frontwardly propelled beyond the openings 80, 82 of channels 76, 78, the pressurized gas emanating from the exploded charge 88 will continue to propel the water out through channels 76, 78 and recoil tubes 52, 54.

It is understood that the recoil of disrupter 16 can be selectively controlled by selecting a specific barrel/side channel diameter ratio. Indeed, if a very small inner diameter side channel is provided and the volume of water is mainly projected out of the barrel front end mouth opening 24, then the recoil will remain important. However, if side channels of larger diameter (although not as large as the barrel's diameter) are used, then the recoil of disrupter 16 will be controlled. At a certain point, if the recoil is sufficiently counteracted by the water being partly reoriented through the lateral channels, then the likelihood of the disrupter being dislodged from its bracket 14 is decreased, if not eliminated, and consequently the likelihood of damage to the equipment surrounding disrupter 16 is substantially decreased.

The purpose of blades 73, 74 integrally carried by the recoil caps 68, 70 and transversely extending rearwardly of the recoil tubes opened rear ends 60, 62, is to break and disperse the water jet which is rearwardly propelled out of recoil tubes 52, 54 so as to help prevent collateral damage to equipment located rearwardly of disrupter 16. This is especially desirable considering that many robots carry the disrupters in an adjustable manner, i.e. that the disrupter support brackets are movable so as to allow the disrupter to be oriented in a selected direction as a function of the spatial position of the bomb. Thus, the disrupter may be oriented in a direction which positions the rear recoil tube openings 60, 62 in facing register with the robot or the video camera, for example. Likelihood of collateral damage resulting from the rearwardly-oriented return water jets will be minimized due to the water jet being dispersed or atomized by blades 73, 74.

As suggested in FIG. 4, disrupter 16 can be disassembled by unscrewing the front nozzle 40, the attachment ring 49, the rear cover 30, the recoil tubes 52, 54 and the tube caps 68, 70. In FIG. 4, the frangible seals 38, 64, 66 have been removed for clarity of the view. Disrupter 16, in its disassembled state, can be more easily stored and carried, for example in a suitable container. For assembling disrupter 16, barrel 18 is to be inserted in the bore 47 of channel member 46, with an alignment pin 94 located on the inner face of bore 47 engaging a corresponding groove (not shown) on barrel 18, to ensure that the inner diverging channels 76, 78 be properly formed by aligning the portions of channels 76, 78 located in the barrel shoulder 44 with the portions of channels 76, 78 located in channel member 46. Once the channel member seat 47*a* abuts against the rear surface of shoulder 44, ring 49 is axially inserted about barrel 18 on the opposite side of shoulder 44, and is screwed onto channel member 46 until both channel member 46 and ring 49 stably and securely abut against either sides of shoulder 44 and against each other. Thus, with the alignment pin 94 and its corresponding groove, diverging channels 76, 78 will be automatically properly formed in disrupter 16.

In the event where, upon the explosive charge 88 detonating inside disrupter 16, there would be an excessive pressure rise inside disrupter 16, several (e.g. four) pressure bleed holes 96 are provided on the periphery of the collar 51*a* of channel member 46, spacedly from side wings 48*a*, 50*a*. Bleed holes 96 register with the position of the apex of the barrel shoulder 44, and would allow excess pressure beyond a certain threshold level, originating either from the fluid or from the gas emanating from the exploded charge 88, to be progressively evacuated therethrough, thus helping to relieve pressure and to substantially reduce the likelihood of eventual accidental structural integrity failure of disrupter 16.

It is understood that any modifications to the present invention, which do not deviate therefrom, are considered to be included therein.

For example, although the diverging recoil channels 76, 78 are shown to form an angled elbow with their respective co-extensive parallel recoil tubes 52, 54, it is not excluded from the scope of this invention that arcuate channels be formed, which would reduce the turbulence of the rearwardly outgoing water flow. However, considering manufacturing cost restrictions during production, angled channels are the preferred way to carry out the invention.

Also, although two diverging side recoil channels with their corresponding tubes are shown, it is understood that more than two tubes could also be used, as long as they are peripherally equally spaced-apart about barrel 18, to prevent radially-oriented forces from being imparted to barrel 18 during the ejection of the water flows by the recoil tubes.

It could further be envisioned that the recoil tubes be integrally formed in the channel member 46, or even that the channel member be integrally formed about the barrel 18. There would then exist continuous recoil channels, which would not be formed out of separate sections in barrel 18, channel member 46 and recoil tubes 52, 54, but of a single section located in the modified barrel main body.

Other suitable fluids than water could be used to fill the disrupter 16, although water is the preferred fluid to carry out the invention.

The frangible seals are not compulsory for disrupter 16 to be operative, although they greatly enhance its versatility. Disrupter 16 could be used without any seals, if a sufficient quantity of water could be contained within the barrel rear end portion, before the side channel openings 80, 82. As long as the disrupter would remain in an upwardly tilted position, it would not accidentally flow out of disrupter 16, and could then be used to deactivate a bomb. It is understood, however, that this is not the preferred way to carry out the invention.

It is to be understood that the present bomb deactivating gun could alternately be used in a non-recoil controlled environment, e.g. with solid or frangible projectile materials instead of water. For example, there could be use Avon-type frangible rounds, ceramic slugs each of which may have a weight of 160 grams for a 20 millimeter (mm) internal diameter barrel, or steel slugs each of which may have a weight of 106 grams for a 20 mm internal diameter barrel, both of the latter particularly suited for disarmining pipe bombs of up to 5.1 centimeters (cm) in diameter.

The internal diameter of the barrel can be for example 12.5, 20 or 29 cm. Alternately, the breech threading could be interrupted at the breech end of the barrel, to facilitate the work of a technician to more quickly engage or disengage the breech. Alternately also, the recoil tubes could be used as disrupters themselves, if the gun is rotated and the recoil tubes water outlet ends are directed toward the bomb target and if their water dispersal brackets are removed therefrom; two high speed jets of water would be generated, ensuring a greater degree of disruption onto the bomb package relative to the single water jet from the original concept main barrel.

Although this disrupter is mainly designed for close (centimeter) range use, it is not excluded from the scope of this invention to use a laser aiming sight, for situations where standoff is required (for a few to several meters range situation), in particular in the case of hazardous manual approach of the bomb target when use of remote control rover is not possible for enhanced safety margin of the operator. The sight could be easily clipped on and off over the disrupter, by use of a suitable support bracket.

I claim:

1. A liquid disrupter for deactivating a bomb comprising:

a main elongated hollow barrel having a rigid cylindrical body with an inner chamber, a closed rear end and an opened front end closed with a front frangible seal;

a channel member having a bore engaged by said barrel, said channel member being securely attached to said barrel;

at least two recoil channels equally peripherally spaced about said barrel, said recoil channels having a first end extending through said barrel cylindrical body and opening inside said barrel inner chamber at a section thereof intermediate said front and rear ends, and a second end rearwardly opening out of said channel member and closed with rear frangible seals, said recoil channels radially outwardly and rearwardly extending through said barrel cylindrical body and said channel member from said first to said second ends;

a remotely selectively controlled trigger member operatively mounted to said barrel;

wherein in operation, an explosive charge is to be placed inside said barrel inner chamber near said rear end and connected to said trigger member, and said barrel body inner chamber and said recoil channels are to be filled with fluid, and wherein upon the explosive charge exploding when it is detonated by said trigger member, a portion of the fluid is ejected at high velocity frontwardly out of said barrel front end, rupturing said front frangible seal, to puncture the bomb outer shell and deactivate the bomb inner detonating components, and another portion of the fluid concurrently engages said recoil channels, rupturing said rear frangible seals, to be rearwardly ejected out of said channels, which at least partly counteracts the rearward recoil resulting from the explosive charge projecting the water frontwardly out of said barrel;

wherein each said recoil channel includes a first and a second channel sections, said first channel section extending through said barrel and said channel member in a radially outwardly and rearwardly inclined fashion relative to said barrel, and said second channel section being a recoil tube securely attached to said channel member and rearwardly projecting from said first channel section, said recoil channel second end being located at the rear end of said recoil tube; and wherein each said recoil tube is provided with transverse blades at its rear end, for wide angle dispersal of the fluid jet being ejected out of said recoil tubes.

2. A liquid disrupter as defined in claim 1, wherein each said recoil tube is provided with a bored cap threadingly engaging its rear end, said cap holding said rear frangible seal and integrally carrying said transverse blade for dispersing the fluid jet being ejected out of said recoil tube.

3. A liquid disrupter for deactivating a bomb comprising:

a main elongated hollow barrel having a rigid cylindrical body with an inner chamber, a closed rear end and an opened front end closed with a front frangible seal;

a channel member having a bore engaged by said barrel, said channel member being securely attached to said barrel;

at least two recoil channels equally peripherally spaced about said barrel, said recoil channels having a first end extending through said barrel cylindrical body and opening inside said barrel inner chamber at a section thereof intermediate said front and rear ends, and a second end rearwardly opening out of said channel member and closed with rear frangible seals, said recoil channels radially outwardly and rearwardly extending through said barrel cylindrical body and said channel member from said first to said second ends;

a remotely selectively controlled trigger member operatively mounted to said barrel;

wherein in operation, an explosive charge is to be placed inside said barrel inner chamber near said rear end and connected to said trigger member, and said barrel body inner chamber and said recoil channels are to be filled with fluid, and wherein upon the explosive charge exploding when it is detonated by said trigger member, a portion of the fluid is ejected at high velocity frontwardly out of said barrel front end, rupturing said front frangible seal, to puncture the bomb outer shell and deactivate the bomb inner detonating components, and another portion of the fluid concurrently engages said recoil channels, rupturing said rear frangible seals, to be rearwardly ejected out of said channels, which at least partly counteracts the rearward recoil resulting from the explosive charge projecting the water frontwardly out of said barrel;

wherein each said recon channel includes a first and a second channel sections, said first channel section extending through said barrel and said channel member in a radially outwardly and rearwardly inclined fashion relative to said barrel, and said second channel section being a recoil tube securely attached to said channel member and rearwardly projecting from said first channel section, said recoil channel second end being located at the rear end of said recoil tube; and wherein said barrel includes a radially protruding peripheral shoulder intermediate said front and rear ends, with said channel member including an inner peripheral channel member seat about said bore for seating abutment against said barrel shoulder, said disrupter further including an attachment ring axially engaging said barrel and including an inner peripheral ring seat for seating abutment against said barrel shoulder opposite said channel member, said ring threadingly engaging said channel member to securely attach said channel member against said barrel.

4. A liquid disrupter as defined in claim 3, wherein said first channel section extends through said barrel and through said barrel shoulder.

5. A liquid disrupter as defined in claim 3, wherein said barrel front end portion is provided with a securely attached nozzle holding said frangible seal against said barrel front end, said nozzle being conically shaped to accelerate the outgoing fluid jet with its conicity inner diameter radially inwardly decreasing axially frontwardly toward said nozzle mouth.

6. A liquid disrupter as defined in claim 5, wherein the nozzle conicity angle is of about 15°.

7. A liquid disrupter as defined in claim 3, wherein said barrel rear end is releasably closed with a removable cover securely attached to said barrel, said cover carrying said trigger member.

8. A recoil-less water gun comprising:

a main elongated having a main rigid body with a first channel, for receiving and holding a volume of water and provided with a front water outlet end mouth and a rear closed end portion, said first channel rear end portion including a well for receiving an explosive charge;

a tubular array integrally mounted in radially outward fashion to a section of said main barrel body intermediate said front and rear end portions thereof, said tubular array consisting of at least two elbowed tube members, said tube members being peripherally equidistant to each other;

each elbowed tube member having:

a forward portion, mounted to and radially outwardly rearwardly extending from said barrel intermediate section and defining a second inner channel, said second channel extending through said barrel body and in liquid communication with said barrel first channel, and a rearward portion, extending in radially spaced parallel fashion relative to said barrel rear end portion and defining a third inner channel in liquid communication with said second inner channel of the latter tube, each one of said third inner channels having a rear water outlet mouth;

wherein each of said second channels extend radially inwardly into said first channel, to define peripherally spaced water flow deflecting ribs, located inside said barrel first inner channel and peripherally of said first channel; and wherein in operation, upon loading a volume of water to fill said first, second and third channels and upon ignition of an explosive charge inside said well, a portion of this volume of water is ejected forwardly along said barrel first channel and outwardly through said barrel front outlet end mouth, while a remaining portion of this volume of water is backflowed rearwardly radially outwardly into said tube members to be ejected rearwardly, whereby the water gun recoil is controlled.

9. A recoil-less water gun as in claim 8, wherein the diameter of each of said second channels is identical to one another but diametrally smaller than any one of said first and third channels.

10. A recoil-less water gun as in claim 9, further including water dispersal members, each mounted to a corresponding one of each of said tube member rearward portion rear outlet mouths, said dispersal members for wide angle dispersal of water flow ejected rearwardly through said rear outlet mouths.

11. A recoil-less water gun as in claim 10, further including a dynamic pressure sensitive frangible seal mounted to at least one of said front outlet end mouth of said barrel and of said rear outlet end mouths of said tube members.

12. A recoil-less water gun as in claim 8, each of said second channels extending radially inwardly into said first channel, to define peripherally spaced water flow deflecting ribs, located inside said barrel first inner channel and peripherally of said first channel, wherein said deflecting ribs assist in the water backflow rearwardly radially outwardly into said tube members after ignition of the explosive charge.

13. A. recoil-less water gun as in claim 8, wherein said barrel front end mouth is conical, for reducing the barrel diameter at its frontmost end to produce a more powerful jet of frontward water flow.

14. A recoil-less water gun as in claim 13, wherein the conicity angle of said barrel conical front end mouth is about 15 degrees.

15. A recoil-less water gun as in claim 12, wherein said barrel front end mouth is conical, for reducing the barrel diameter at its frontmost end to produce a more powerful frontward ejected water flow.

16. A recoil-less water gun as in claim 15, wherein the conicity angle of said barrel conical front end mouth is about 15 degrees.

* * * * *